United States Patent [19]

Parsons

[11] 4,138,956

[45] Feb. 13, 1979

[54] TUFTING NEEDLE MODULAR UNIT

[75] Inventor: Ronald Parsons, Blackburn, England

[73] Assignee: Spencer Wright Industries, Inc., Chattanooga, Tenn.

[21] Appl. No.: 907,551

[22] Filed: May 19, 1978

[30] Foreign Application Priority Data

Jun. 30, 1977 [GB] United Kingdom ..... 27478/77

[51] Int. Cl.[2] ..... D05B 55/02

[52] U.S. Cl. ..... 112/226; 112/79 R

[58] Field of Search ..... 112/79 R, 79.5, 222, 112/226

[56] References Cited

U.S. PATENT DOCUMENTS

| | | | |
|---|---|---|---|
| 204,294 | 5/1878 | Cook et al. | 112/226 |
| 3,485,195 | 12/1969 | Torrence | 112/79 R |
| 3,618,542 | 11/1971 | Zocher | 112/79 R |
| 3,763,805 | 10/1973 | Weigert | 112/226 |
| 4,014,278 | 3/1977 | Jolley et al. | 112/79 R |

FOREIGN PATENT DOCUMENTS

| | | | |
|---|---|---|---|
| 2004726 | 8/1971 | Fed. Rep. of Germany | 112/79 R |

*Primary Examiner*—Ronald Feidbaum

*Attorney, Agent, or Firm*—Alan Ruderman

[57] ABSTRACT

A tufting machine needle module having a body member attachable to the needle bar of the tufting machine. The module has a plurality of longitudinally spaced needles formed integrally with the body member and depending therefrom in parallel relationship. The body member includes co-operable male and female formations on respective front and rear faces thereof spaced at equal distances longitudinally on the respective face with those of one face offset longitudinally relative to those of the other face by a distance equal to an odd number multiple of one-half the pitch of the needles carried by the body member. The modules are arranged in two rows one behind the other with the male and female formations of modules in respective rows cooperating with those of the other row so that the modules in a row are offset from the modules in the other row by one-half the pitch of the needles on each module.

10 Claims, 5 Drawing Figures

TUFTING NEEDLE MODULAR UNIT

The invention concerns tufting machine gauge parts and has particular, though not exclusive, reference to a needle bar construction for use in forming fine gauge pile fabrics.

In the tufting art the gauge of a pile fabric is determined by the spacing between adjacent gauge parts, i.e. the needles, loopers and knives, of the tufting machine. Thus, the spacing between or the pitch of the needles is the measure of the gauge of the pile fabric produced. In fine gauge fabrics, i.e. one tenth gauge or smaller, the spacing between the point of one needle and the point of the adjacent needle is 0.1 inch or smaller. As a consequence of the close spacing between adjacent needles in fine gauge tufting machines great difficulty has been experienced in providing arrangements wherein the spacing of the needles might be set at a requisite level and/or maintained at such level. Moreover, in fine gauge tufting machines it is common to locate the needles in two transverse rows, one behind the other, with the needles in one row staggered or offset with respect to the needles in the other row. The staggered needle construction is such that the needles in each row are offset preferably midway between the needles in the other row to provide uniform needle gauge. An example of such a construction is illustrated in U.S. Pat. No. 3,492,956.

Furthermore, in the event of damage to a needle or series of needles which causes such needles to deviate from their requisite spacing, the replacement of the needle or needles is a time-consuming, and hence expensive, operation. The fitting of a new bank of needles, to replace a worn set, is particularly demanding of time.

The primary object of the invention is to provide a means whereby the provision of needles at a requisite close spacing and the ready fitting of a replacement needle or needles might be facilitated, and the time required therefor significantly reduced.

According to the present invention there is proposed a needle module for the needle arrangement of a tufting machine which comprises a body part adapted to be attached to the needle bar of the said tufting machine and having a plurality of needles formed integrally therewith to depend in spaced parallel, side-by-side disposition therefrom, the length of the module being equal to or substantially equal to a multiple of the pitch of the needles supported by such module and the number of needles being equal to such multiple.

Preferably, the needles are symmetrically disposed on the said body part.

According to a further preferred feature, the body part includes co-operable male and female formations on the front and rear faces of the body part, the said formations being at like spacing in a direction transverse to the needle axes and the formations at one face being offset in relation to those at the other face by a distance equal to one half the pitch of the needles carried by such body part or an odd number multiple of such one half pitch.

The invention also includes a needle assembly comprising a multiplicity of needle modules as aforesaid in two rows arranged one behind the other, the modules in one row being offset in relation to the respective corresponding modules in the other row by one half of the pitch of the needles on the module.

The invention will now be described further by way of example only, with reference to the accompanying drawings illustrating one embodiment and in which.

Figure 1:
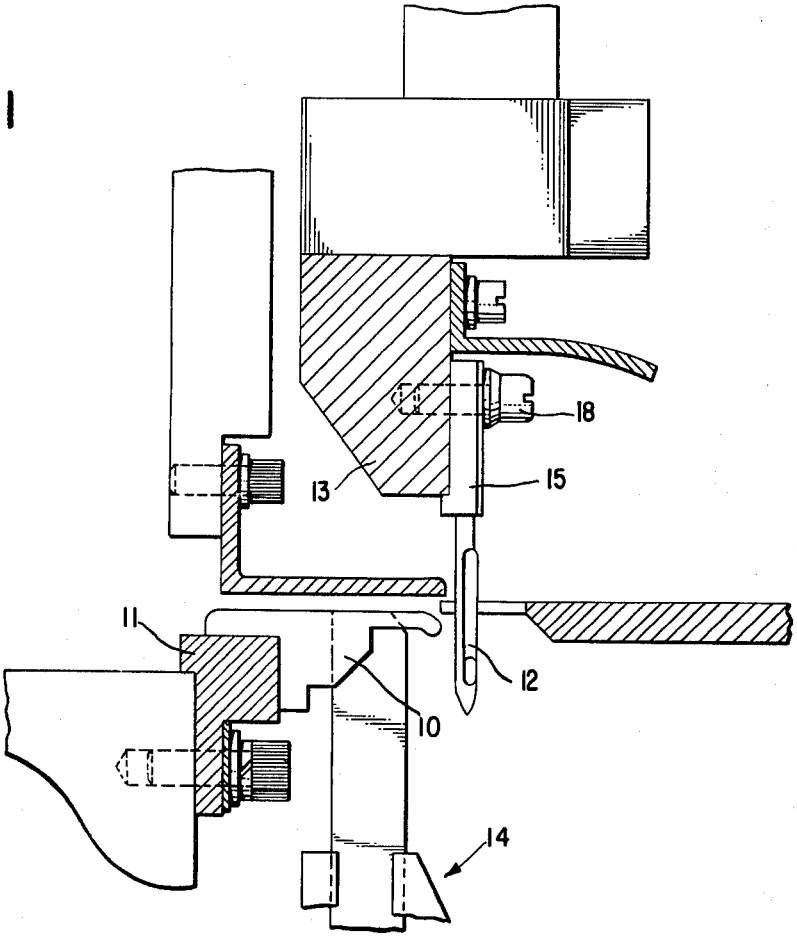
FIG. 1 is a diagrammatic side sectional elevation of a part of a tufting machine embodying the present invention but showing only a single row of modular needle units.

Referring now to the drawings, and particularly to FIG. 1 thereof, a tufting machine hook or looper 10 is supported in a looper block 11 for oscillating motion to pick up a loop of yarn from a needle 12 supported on a needle bar 13, the needle bar 13 being reciprocable in the axial direction of the needle in conventional manner. The looper 10 is co-operable with a knife mechanism 14 oscillating in timed relationship therewith for cutting the loop of yarn to form cut pile.

Figure 2:
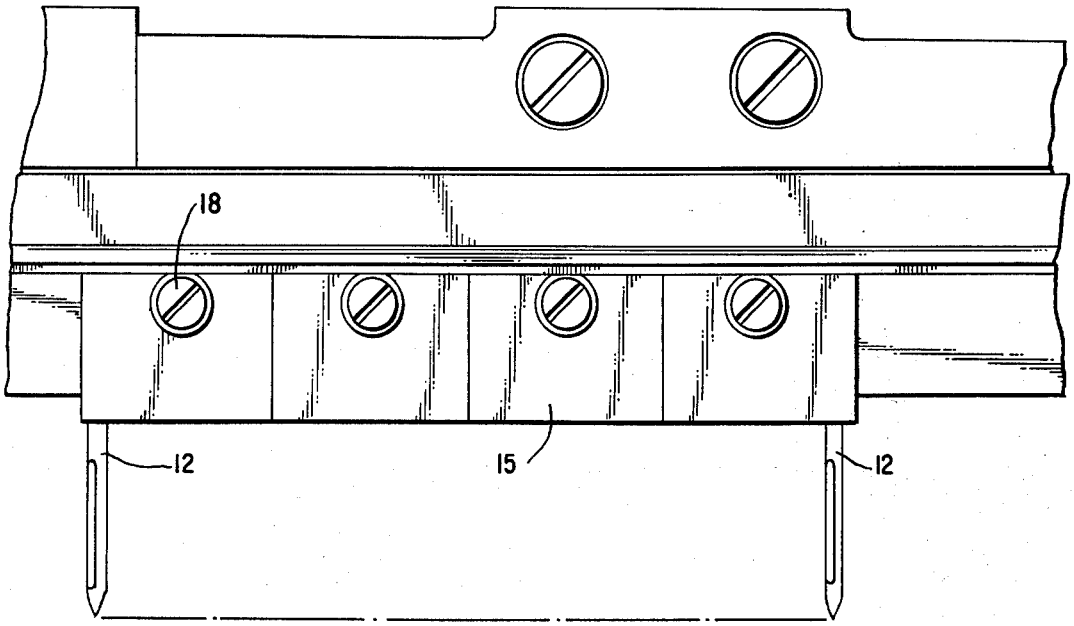
FIG. 2 is a front elevation of a part of the arrangement shown in FIG. 1.
Figure 3:
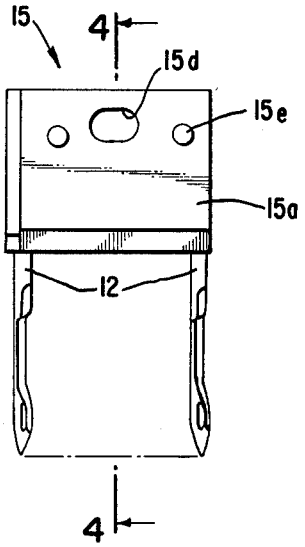
FIG. 3 is a front elevation of a corresponding pair of needle modules each constructed in accordance with the invention.
Figure 4:
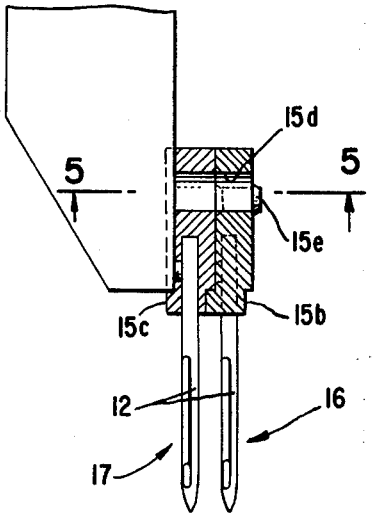
FIG. 4 is a section taken on line 4—4 of FIG. 3.
Figure 5:
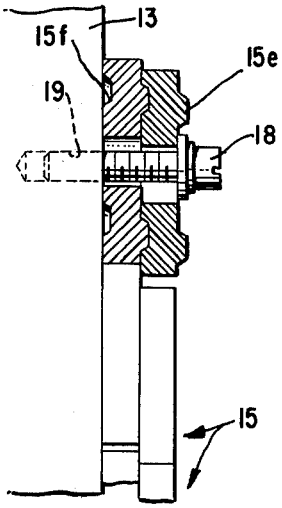
FIG. 5 is a section taken on line 5—5 of FIG. 4.

In accordance with the invention, the needles are provided in modular units 15 attachable to the needle bar, such modular units being shown generally in FIG. 2 and in detail in FIGS. 3 to 5.

Referring now to FIGS. 3 to 5, each modular unit 15 is generally rectangular, being approximately 1.25 inches long, 1.0 inches high and 0.25 inches thick, and supports any convenient number of tufting needles 12, five tufting needles being illustrated depending from the underside thereof, the modular units 15 being arranged as two rows of units 16, 17, the individual units 15 of each row being in end-to-end abutting disposition and the two rows 16, 17 being arranged one behind the other. The individual modular units 15 are each of integral form and of molded or cast construction. At its front lower edge the body part **15*a* of the modular unit is rebated to form an angular step 15*b*, whilst at the opposite lower edge the body part includes an integral lip or flange 15*c* of like dimensions to the said rebate. An elongate aperture 15*d* is formed in the body part 15*a* in the upper region thereof, the major axis of such aperture being parallel to the longitudinal edges of the body part and the minor axis preferably lying in the median plane thereof. Two truncated conical protuberances 15*e* are provided in the front face of the body part, such protuberances being arranged one at either side of the elongate aperture 15*d* and preferably slightly below the line of the major axis thereof, whilst two truncated conical recesses 15*f* are provided in the rear face of the body part in like disposition relative to the line of the said major axis as the protuberances and at like spacing to the spacing of the said protuberances, the said recesses and protuberances being arranged in offset disposition in the longitudinal direction of the body part by an amount equal to the intended pitch of the needles 12** of the two rows of modular units when considered collectively.

As can best be seen from FIGS. 3 and 4, in practice the individual modular units 15 are arranged in two rows of such units disposed one behind the other, the units of one row being offset slightly in relation to the corresponding module of the other row in the longitudinal direction of the needle bar, and corresponding pairs of modules of the two rows preferably being attached to the needle bar by a common screw 18 or the like which passes through the aligned elongate apertures 15*d* in the two units and engages a respective screw-threaded hole 19 in the needle bar 13. The extent to which the individual ones of each pair of corresponding modular units are offset is determined by the relative positions of the protuberances 15*e* and recesses 15*f* in the front and rear faces respectively of the body parts 15*a*, and such positions are so arranged as to give a relative displacement as between the corresponding units upon engagement of the protuberances on the front face of the rearmost modular units with the recesses in the rear face of the foremost unit equal to the intended needle pitch of the needle assembly as a whole.

The needles 12 in each modular unit 15 are symmetrically arranged on such unit, the axis of the extreme needle in each case being spaced from the end of the body part by a distance equal to the intended pitch of the needle assembly as a whole.

By providing the needles in groups on separate modular units, so we are able to replace broken or damaged needles simply by replacing the modular unit concerned, which operation can be effected in a ready and rapid manner, the setting of the needles in relation to the remaining needles being automatically effected by virtue of the geometry of the unit.

The rigidity of the needle assembly as a whole is enhanced by the co-operating protuberances and recesses of the corresponding modular units and by the co-operating rebates and flanges of such units, and a total structure well fitted for its purpose results.

The accuracy with which the modular units might be produced, and the facility with which such units might be assembled together avoids various of the problems met with in connection with the conventional arrangements.

The invention is not restricted to the exact features of the embodiment disclosed since alternatives will readily present themselves to one skilled in the art.

Thus, for example, instead of the co-operating truncated conical protuberances and recesses, other co-operating male and female formations may be preferred. Furthermore, any tolerance as between the co-operating male and female formations will provide a facility for relative adjustment as between corresponding modular units in the longitudinal direction of the needle bar within the limits of such tolerances.

Whilst, in the embodiment disclosed in FIGS. 3 to 5, the modular units are provided in pairs each for inclusion in a respective one of two rows of units arranged one behind the other, a single row only of such units may be used in a coarse gauge tufting machine in the matter illustrated in FIGS. 1 and 2, the double row concept as envisaged in FIGS. 3 to 5 providing for the mounting of the modular units on the needle bar in analogous manner to that shown in FIGS. 1 and 2.

Having thus set forth the nature of the invention, what is claimed herein is:

1. A tufting needle module comprising a body member having front and rear longitudinally extending surfaces, a plurality of similarly disposed elongated needles integrally formed with the body member and having point portions depending therefrom, said needles being equally spaced apart longitudinally along the body member, the spacing between adjacent needles defining the pitch of the needles of said module, protuberance means defining at least one male formation on one of the front and rear surfaces, recess means defining a like number of female formations on the other of said surfaces, said male formations being offset longitudinally from said female formations by a distance equal to an odd number multiple of one-half the pitch of the needles, said female formations being sized to cooperatively receive a male formation, and each of said male and female formations being at like equal spacing longitudinally along respective faces, whereby two such modules may be cooperatively arranged in a two row assembly with the front surface of one in engagement with the rear surface of the other and needles in one row offset from those in the other row by one-half the pitch of the needles of each module.

2. A tufting needle module as recited in claim 1 wherein there are two male and two female formations.

3. A tufting needle module as recited in claim 1 wherein said odd number is equal to one.

4. A tufting needle module as recited in claim 1 wherin said body member includes means defining an elongated aperture, said aperture having a major axis extending longitudinally relative to said surfaces for receiving a common mounting member through two such modules in a two row assembly.

5. A tufting needle module as recited in claim 1 wherein said surfaces having said male formations includes a rebated step at its lower edge, and the surface having said female formations includes a protruding lip of equal dimension to said step.

6. A needle assembly comprising at least two rows of needle modules arranged one behind the other, each module comprising a body member having front and rear longitudinally extending surfaces, a plurality of similarly disposed elongated needles integrally formed with the body member and having point portions depending therefrom, said needles being equally spaced apart longitudinally along the body member, the spacing between adjacent needles defining the pitch of the needles of each module, protuberance means defining at least one male formation on one of the front and rear surfaces, recess means defining a like number of female formations on the other of said surfaces, said male formations being offset longitudinally from said female formations by a distance equal to an odd number multiple of one-half the pitch of the needles, said female formations being sized to cooperatively receive a male formation from a module in an adjacent row, and each of said male and female formations being at like equal spacing longitudinally along respective faces, whereby the front surface of the modules in one row cooperatively engage the rear surface of respective modules in an adjacent row and the modules of one row are off-set in relation to the respective modules in the other row by one-half the pitch of the needles of each module.

7. A needle assembly as recited in claim 6 wherein each row of modules comprises a multiplicity of longitudinally abutting modules.

8. A needle assembly as recited in claim 6 wherein each module includes two male and two female formations.

9. A needle assembly as recited in claim 6 wherein the body member of each module includes means defining an elongated aperture, said aperture having a major axis extending longitudinally relative to said surfaces for receiving a common mounting member through respective modules in adjacent rows.

10. A needle assembly as recited in claim 6 wherein said surface having said male formations includes a rebated step at its lower edge, and the surface having said female formations includes a protruding lip of equal dimension to said step, whereby the protruding lip of the modules in one row cooperatively engage the rebated step of respective modules in an adjacent row.

* * * * *